US005230656A

United States Patent [19]

Paterson et al.

[11] Patent Number: 5,230,656

[45] Date of Patent: Jul. 27, 1993

[54] MIXER EJECTOR FLOW DISTRIBUTOR

[75] Inventors: Robert W. Paterson, Simsbury, Conn.; Walter M. Presz, Jr., Wilbraham; Bruce L. Morin, Springfield, both of Mass.

[73] Assignee: Carrier Corporation, Syracuse, N.Y.

[21] Appl. No.: 925,000

[22] Filed: Aug. 5, 1992

[51] Int. Cl.[5] ..... F24F 13/00

[52] U.S. Cl. ..... 454/263; 239/590.5; 454/284; 454/305

[58] Field of Search ..... 234/125, 590.5; 454/261, 262, 263, 269, 284, 292, 300, 302, 305, 310

[56] References Cited

U.S. PATENT DOCUMENTS

| | | | |
|---|---|---|---|
| 2,209,121 | 7/1940 | Hoherkamp | 454/261 |
| 2,684,024 | 7/1954 | Kurth et al. | 454/261 |
| 2,791,170 | 5/1957 | Phillips et al. | 454/302 X |
| 2,825,274 | 3/1958 | Kurth et al. | 454/261 |
| 2,872,859 | 2/1959 | Kennedy | 454/263 |
| 4,776,535 | 11/1988 | Paterson et al. | 244/130 |
| 4,789,117 | 12/1988 | Paterson et al. | 244/130 |
| 4,813,633 | 3/1989 | Werle et al. | 244/130 |
| 4,813,635 | 3/1989 | Paterson et al. | 244/130 |
| 4,815,531 | 3/1989 | Presz, Jr. et al. | 165/151 |
| 4,830,315 | 5/1989 | Presz, Jr. et al. | 244/200 |
| 4,835,961 | 6/1989 | Presz, Jr. et al. | 60/264 |
| 4,971,768 | 11/1990 | Ealba et al. | 422/176 |
| 5,052,285 | 10/1991 | Rich | 454/302 X |
| 5,110,560 | 5/1992 | Presz, Jr. et al. | 422/176 |

FOREIGN PATENT DOCUMENTS

| | | | |
|---|---|---|---|
| 161335 | 7/1986 | Japan | 454/261 |
| 64300 | 3/1990 | Japan . | |
| 932138 | 5/1982 | U.S.S.R. | 454/261 |

*Primary Examiner*—Harold Joyce

[57] ABSTRACT

An apparatus for attaining improved flow uniformity through and at the exit of an air duct by mixing and distributing the air flow. The apparatus has a wall containing a plurality of convoluted corrugations or lobes arranged in conjunction with an airfoil shaped faired body to form an ejector passage between the wall and the faired body. There is a primary flow passage on the side of the wall opposite the ejector passage. The corrugations extend into both the primary flow and ejector flow passages so that a lobe in one passage is a trough in the other passage. Air flow in the primary flow passage acts to cause a flow through the ejector passage and thus a suction in the inlet to the ejector passage. The suction acts upon streamlines around the apparatus to obtain improved downstream air flow performance. One embodiment of the flow distributor increases the spreading half angle at the exit of an air flow duct. Another embodiment improves the velocity distribution profile across the duct downstream of a bluff body in the duct.

3 Claims, 6 Drawing Sheets

MIXER EJECTOR FLOW DISTRIBUTOR

BACKGROUND OF THE INVENTION

This invention relates generally to air handling systems. More particularly the invention relates to devices that improve the flow characteristics of air in ducts and across heat exchangers.

In many applications involving the flow of air through ducting in air handling systems, air flows from an exhaust port in a first duct into another duct, plenum or other larger volume. As the air exits the first duct, the air stream undergoes spreading. The jet spreading angle from a simple exhaust port such as the end of a circular ventilation pipe tends to be on the order of 5 to 8 degrees half angle. This is shown schematically in FIG. 1 where air exiting the end of duct 10 spreads to half angle $\alpha$ as it enters the space downstream of the duct. The spreading half angle is a function of the eddy structure of the free shear layer turbulence at the exhaust port.

There are many applications in which a larger spreading angle would be highly desirable. One such application is the interface between the air flowing through a duct and a downstream heat exchanger. A heat exchanger is frequently installed in a plenum that is larger in cross sectional area than the ducting upstream of the heat exchanger. Heat exchange efficiency would be enhanced if there were a uniform amount of air flowing over and through the entire face of the heat exchanger. However, if the spreading angle of the air leaving the upstream duct is not sufficient, the bulk of the air may flow through just a portion of the face of the heat exchanger with other portions receiving insufficient air flow for optimum performance.

Other benefits accrue when a larger spreading angle can be achieved at an exhaust port. There is greater flow uniformity leading to reduced air flow noise and reduced pressure losses in the ducting downstream of the exhaust port.

Frequently, the configuration of an air handling system includes bluff bodies that are installed in the ducting. A typical example of such a bluff body is a motor installed to power a fan in the duct. FIG. 2A shows schematically bluff body 02 installed in air flow duct 01'. As air flows around the bluff body, the wake immediately downstream of the body forms into a recirculation zone where air swirls in an eddy and does not flow smoothly down the duct. The result is a velocity profile across the duct as is shown in FIG. 2B, where the is a pronounced decrement in the downstream flow velocity immediately behind the bluff body.

Prior art efforts to produce streamline turning or increase jet spreading angle have included turning vanes, screens, perforated plates and other flow deflectors or obstructions located downstream of an exhaust port or bluff body. Although such devices can improve downstream flow uniformity, they do so at the cost of excessive and undesirable pressure losses. Other prior art devices have included various convoluted surfaces to reduce bluff body and blunt trailing edge airfoil drag. These devices are generally effective but do not include ejectors and therefore do not offer the wake minimization and drag reduction potential that an ejector feature combined with a surface convolution can.

SUMMARY OF THE INVENTION

The present invention is a mixer ejector flow distributor to increase the uniformity of the flow exiting an exhaust port in an air duct by increasing the spreading angle of the jet exiting the port or to increase the uniformity of flow immediately downstream of a bluff body in the duct. Increasing the jet spreading angle is an improvement in many applications. Improvement in flow uniformity results in reduced noise, lower duct pressure losses and can improve the performance of a heat exchanger located downstream of the exhaust port or bluff body.

The flow distributor comprises a wall installed in conjunction with a faired body having an airfoil cross section to form an ejector passage between one side of the wall and the faired body. There is a primary flow passage on the other side of the wall. The wall has a plurality of convoluted corrugations or lobes that extend into both the primary flow and ejector flow passages so that a lobe in one passage is a trough in the other passage. Air flow in the primary flow passage acts to cause a flow through the ejector passage and thus a suction at the inlet to the ejector passage.

In an application involving a duct exhaust port, the flow distributor is installed at the outlet of the exhaust port, with the faired body surrounding the convoluted wall. An outlet cuff, closed at its upstream, with respect to primary air flow direction, end, surrounds the faired body to form a recirculating air passage between the cuff and the faired body. The recirculating air passage has a recirculating air inlet formed between the trailing edge of the faired body and the downstream end of the outlet cuff. The suction at the inlet to the ejector passage causes a flow of air in the recirculating air passage and a suction at the recirculating air inlet. This suction turns the streamlines of the air jet exiting the flow distributor and results in a spreading angle that is much larger than is present in the exhaust from a duct without a flow distributor.

In an application involving a bluff body installed in an air duct, the flow distributor is installed at and immediately downstream of the bluff body. The faired body is mounted inside the convoluted wall. The suction at the ejector passage inlet causes a strong inward deflection of the streamlines from the bluff body, minimizing wake defect and producing an associated increase in base pressure and reduced drag as well as a more uniform air flow velocity profile downstream of the bluff body.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 3:
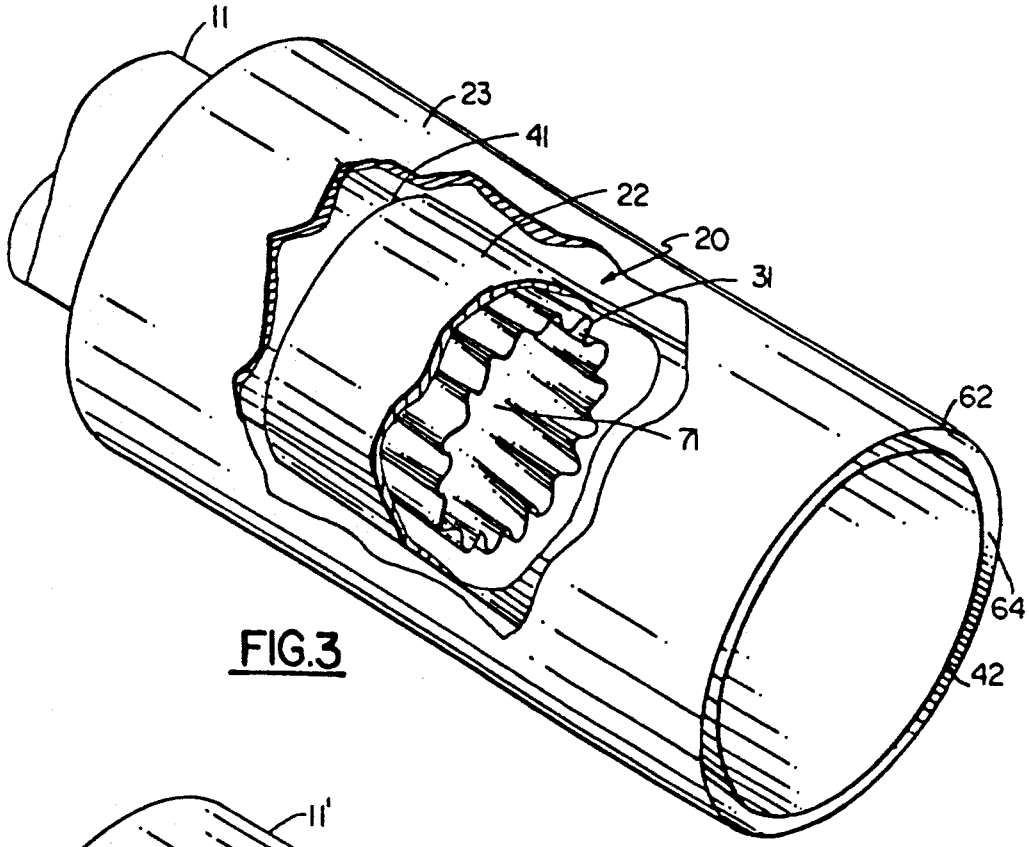
FIG. 3 is an isometric view of a duct containing one embodiment of the mixer ejector flow distributor of the present invention.
Figure 4B:
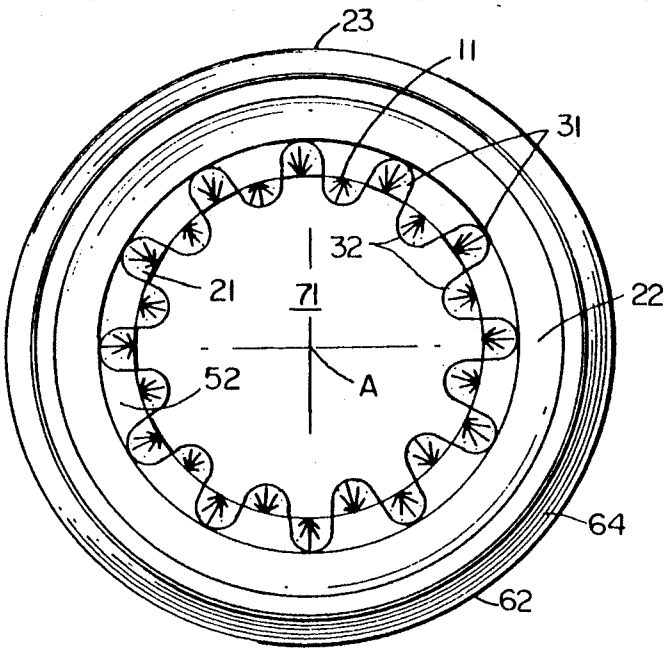
FIG. 4B is an end view of the embodiment of the present invention depicted in FIG. 3.
Figure 4A:
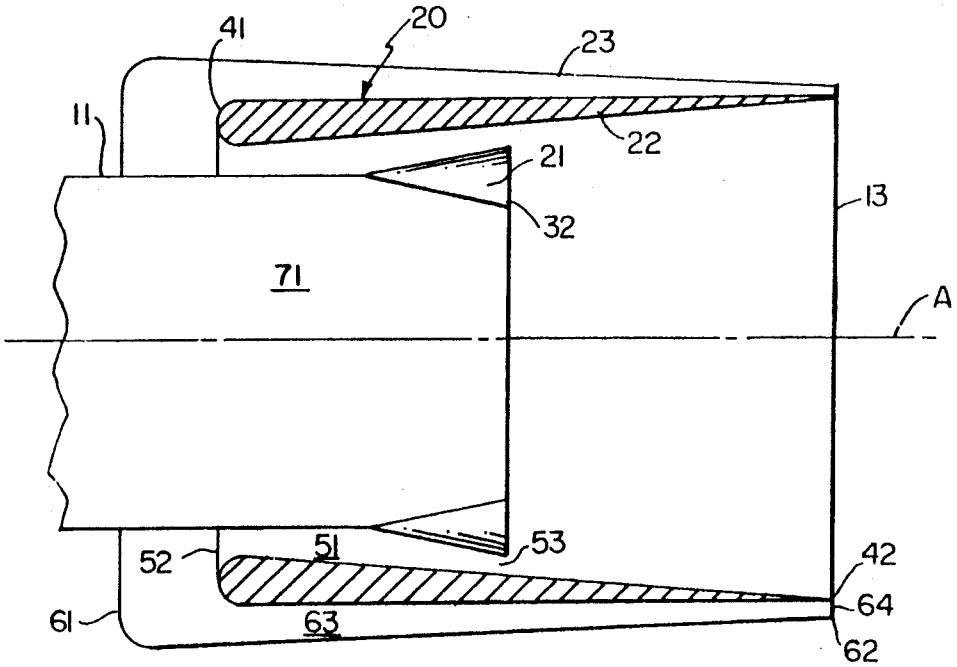
FIG. 4A is a sectioned view of the embodiment of the present invention depicted in FIG. 3.
Figure 5:
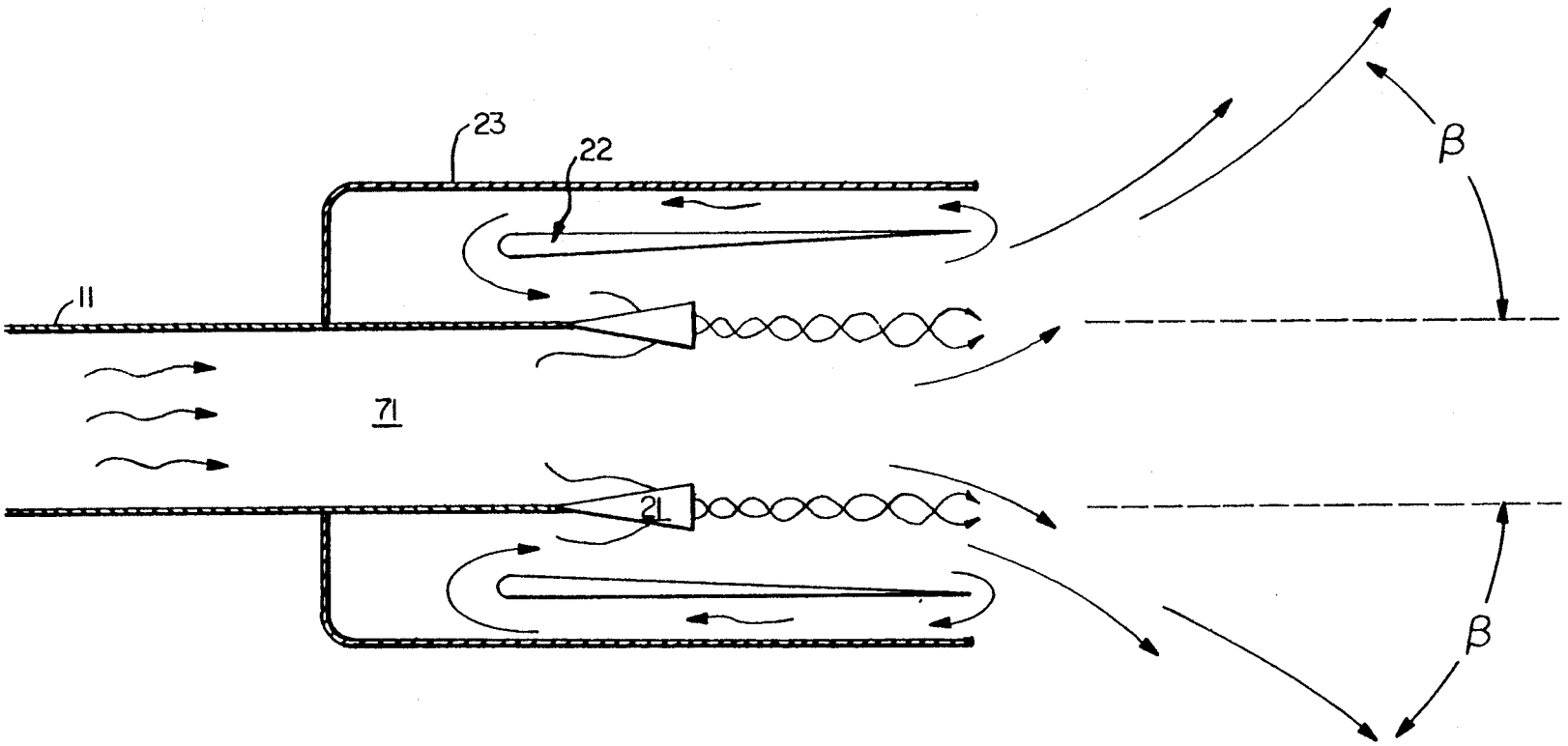
FIG. 5 is a is a schematic diagram of the embodiment of the present invention depicted in FIG. 3 showing the flow of air through the embodiment.

FIGS. 3, 4A and 4B depict one embodiment of the present invention. FIG. 5 depicts schematically the air flow in the embodiment. In that embodiment, a mixer ejector flow distributor is installed at the outlet of an air duct in order to increase the amount of spreading of the air flow exiting the duct. This embodiment of the invention would be employed, for example, at the outlet of a duct into a plenum containing a heat exchanger in order to increase the uniformity of air flow over the face of the heat exchanger.

In the embodiment shown in FIGS. 3, 4A and 4B, mixer ejector flow distributor 20 is fitted around the outlet of duct 11. Flow distributor 20 comprises wall means 21, faired body 22 and outlet cuff 23. Faired body 22 has a cross section, in a plane that passes through axis of symmetry A of both duct 11 and flow distributor 20, that is generally an airfoil, that airfoil having leading edge 41 and trailing edge 42. Faired body 22 is outside, with respect to axis A, of wall means 21. Ejector passage 51, from extending ejector inlet 52 to ejector outlet 53, is formed between wall means 21 and faired body 22. Outlet cuff 23, also symmetrical about axis A, fits around faired body 22. Upstream end 61 of cuff 22 is closed around duct 11 while downstream end 62 of the cuff is open. Recirculating air inlet 64 is formed between cuff downstream end 62 and trailing edge 42 of faired body 22. Recirculating air passage 63, extending from recirculating air inlet 64 to ejector inlet 52, is formed between faired body 22 and outlet cuff 23. The interior of duct 11 forms primary flow passage 71. Wall means 21 separates primary flow passage 71 from ejector flow passage 51.

In wall means 21 are a plurality of circumferentially spaced lobes 31 aligned longitudinally to the direction of air flow in primary flow passage 71 and extending entirely around the periphery of duct 11. Lobes 31 penetrate alternately into both primary flow passage 71 and ejector flow passage 51 so that a lobe in one of the passages is a trough in the other. The height of lobes 31 increases gradually in a upstream to downstream direction. Lobes 31 have lobe end 32 that, when viewed from downstream (FIG. 4B), presents a wave-like appearance.

Figure 1:
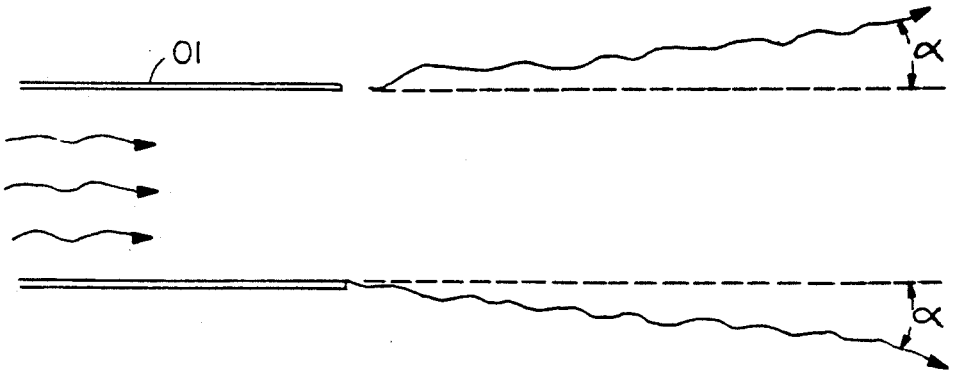
FIG.1 Prior Art
FIG. 1 is a schematic diagram showing the flow of air exiting a prior art duct.

FIG. 5 shows mixer ejector flow distributor 20 in operation. When there is a flow of air in primary flow passage 71 of duct 11 as from the discharge of a fan located upstream in the duct, a primary flow of air passes through the lobes of wall means 21. Mixing interaction between the primary air flow and air from ejector passage 51 causes a flow of air in ejector passage 51. This in turn causes a flow of air in recirculating air passage 63 and a suction at recirculating air inlet 54. This suction turns the streamlines of the air jet exiting flow distributor 20 outward and results in a spreading half angle $\beta$ that is much larger than the half angle that would exist in the exhaust from a duct without a flow distributor (Cf. angle $\alpha$ in FIG. 1).

Figure 6:
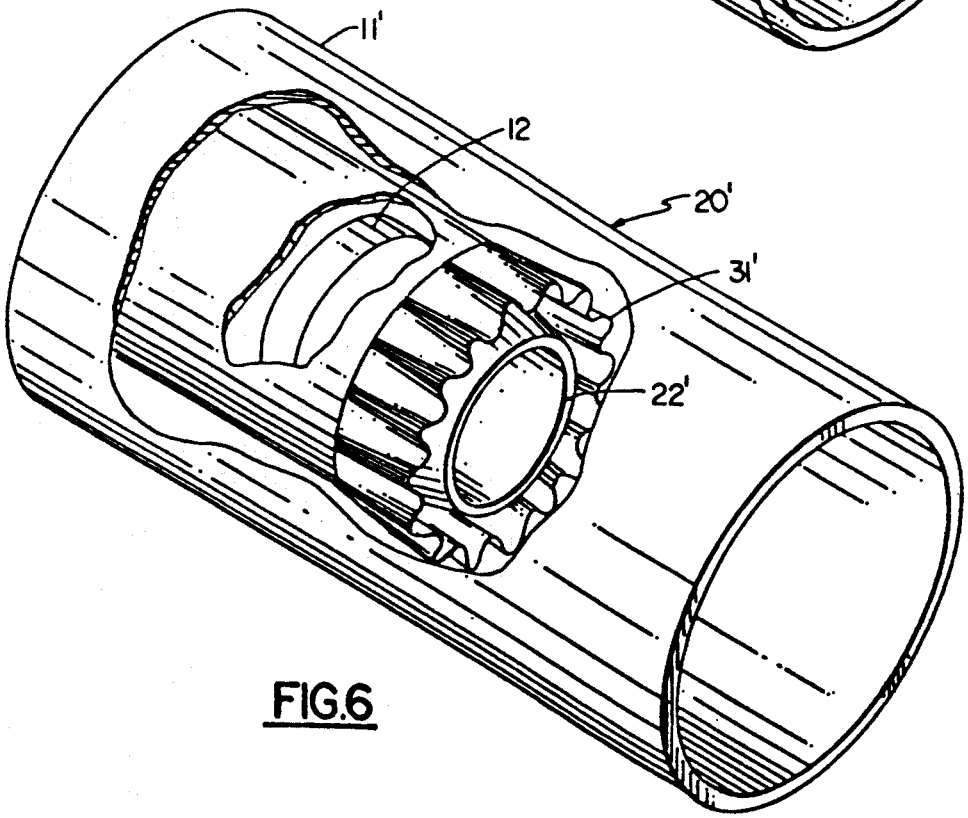
FIG. 6 is an isometric view of a duct containing another embodiment of the mixer ejector flow distributor of the present invention.
Figure 7B:
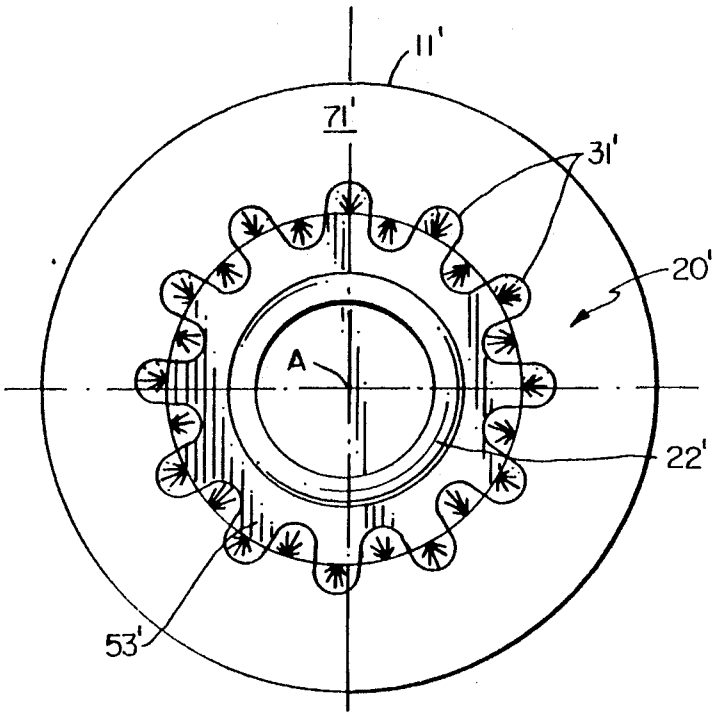
FIG. 7B is an end view of the duct containing the embodiment of the present invention depicted in FIG. 6.
Figure 7A:
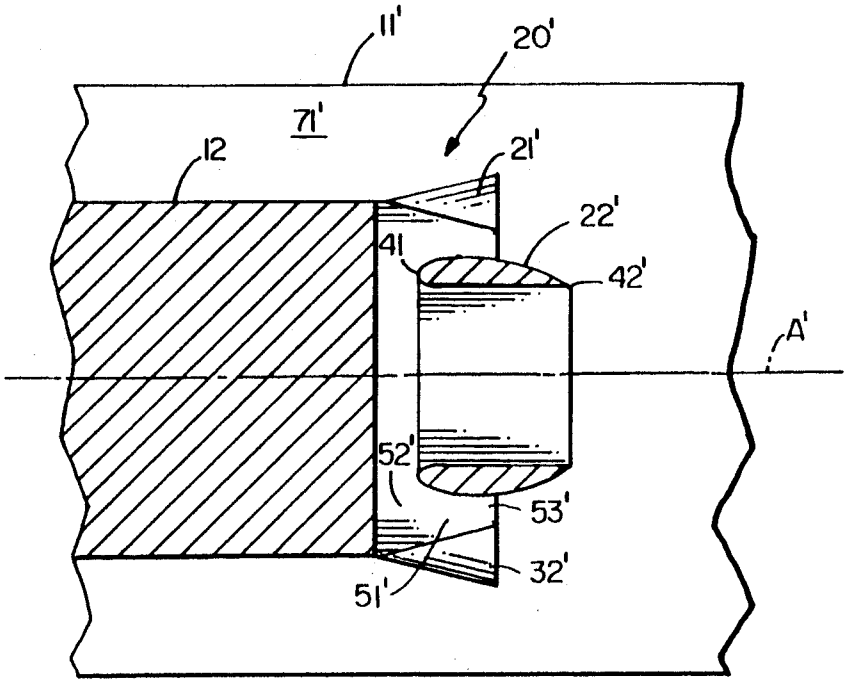
FIG. 7A is a sectioned view of the duct containing the embodiment of the present invention depicted in FIG. 6.
Figure 8B:
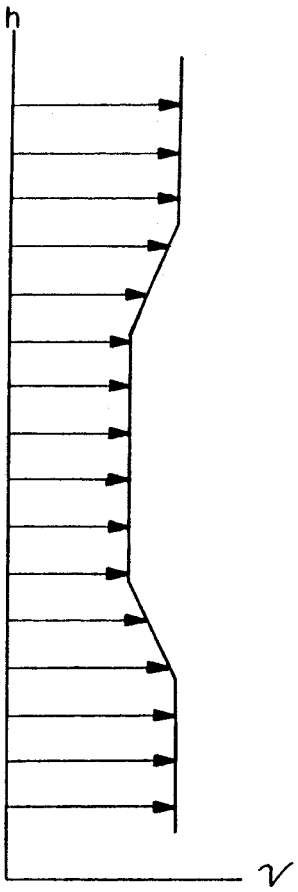
FIG. 8B is a velocity profile across the duct depicted in FIG. 6.
Figure 8A:
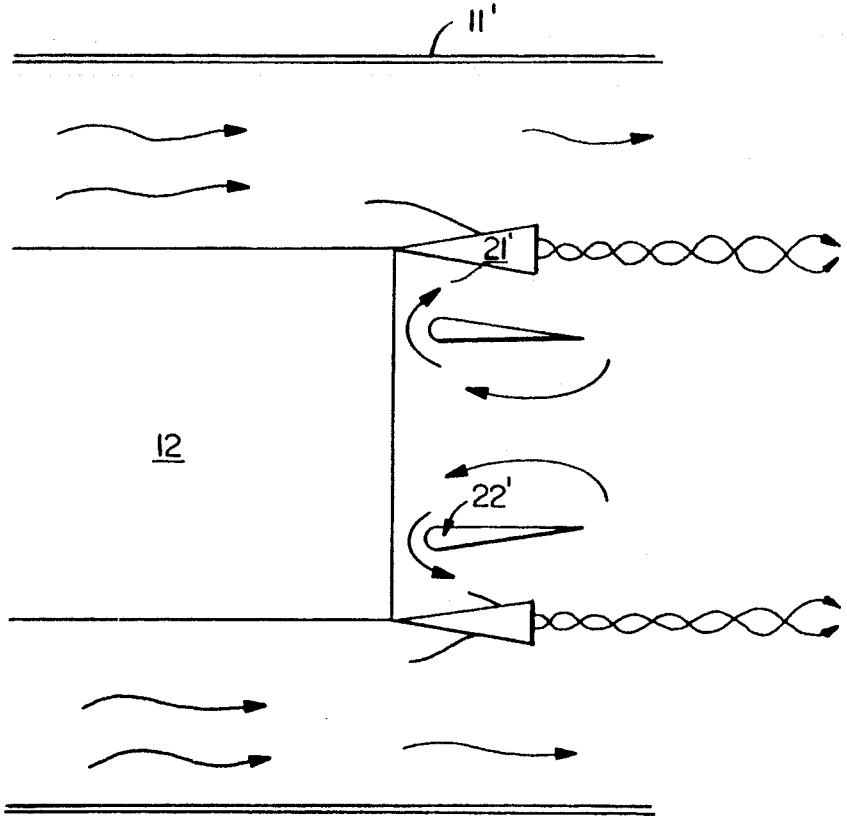
FIG. 8A is a schematic diagram of the duct containing the embodiment of the present invention depicted in FIG. 6 showing the flow of air through the embodiment.

FIGS. 6, 7A and 7B depict another embodiment of the present invention. FIGS. 8A and 8B depict, respectively, schematically the air flow in the embodiment and the velocity profile across the duct in which the invention is installed. In this embodiment, a mixer ejector flow distributor is installed at and downstream of a bluff body in an air duct. The flow distributor functions to reduce the variation of air flow velocities across the duct at a point downstream of the body. This embodiment of the invention would be employed, for example, downstream of a fan motor or other bluff body in a duct to reduce bluff body drag and velocity gradients and, as well, to reduce pressure losses in the duct due to the presence of the bluff body.

In the embodiment shown in FIGS. 6, 7A and 8B, mixer ejector flow distributor 20' is fitted at the downstream end of bluff body 12, which body is located in duct 11'. Flow distributor 20' comprises wall means 21' and faired body 22'. Faired body 22' has a cross section, in a plane that passes through axis of symmetry A' of both duct 11' and flow distributor 20', that is generally an airfoil, that airfoil having leading edge 41' and trailing edge 42'. Faired body 22' is inside, with respect to axis A', of wall means 21'. Ejector passage 51', from ejector inlet 52' to ejector outlet 53', is formed between wall means 21' and faired body 22'. The interior of duct 11' around bluff body 12 forms primary flow passage 71'. Wall means 21' separates primary flow passage 71' from ejector flow passage 51'.

In wall means 21' are a plurality of circumferentially spaced lobes 31' aligned longitudinally to the direction of air flow in primary flow passage 71' and extending entirely around the periphery of bluff body 12. Lobes 31' penetrate alternately into both primary flow passage 71' and ejector flow passage 51' so that a lobe in one of the passages is a trough in the other. The height of lobes 31' increases gradually in a upstream to downstream direction. Lobes 31' have lobe end 32, that, when viewed from downstream (FIG. 7B), presents a wave-like appearance.

Figure 2A:
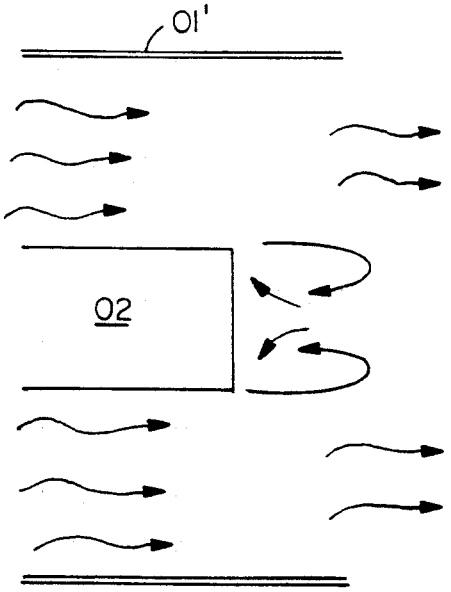
FIG.2A Prior Art
FIG. 2A is a schematic diagram showing the flow of air around a bluff body installed in a prior art duct.
Figure 2B:
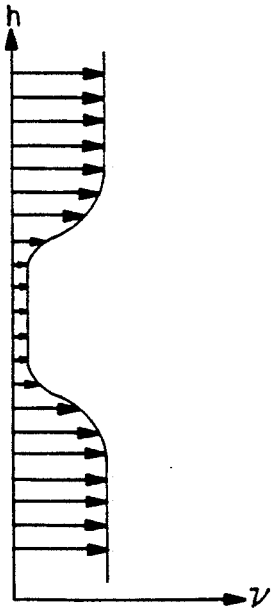
FIG.2B Prior Art
FIG. 2B is a velocity profile across the prior art duct depicted in FIG. 2A.

FIG. 8A shows mixer ejector flow distributor 20' in operation. When there is a flow of air in primary flow passage 71' of duct 11', a primary flow of air passes through the lobes of wall means 21'. Mixing interaction between the primary air flow and air from ejector passage 51' causes a flow of air in ejector passage 51' and a resulting suction at ejector inlet 52'. This suction in turn causes a strong inward deflection of the bluff body wake streamlines, minimizing wake defect and producing an associated increase in base pressure, hence reducing drag from the bluff body. As shown in FIG. 8B, this effect results in a more uniform air flow velocity profile across duct 11' downstream of bluff body 12 (Cf. the profile shown in FIG. 2B).

FIGS. 3, 4B, 6 and 7B show ducting and flow distributors that are circular in lateral cross section. The present invention envisions that applications of its flow distributor in ducting of other lateral cross sectional configurations, such as square, rectangular or oval, are equally feasible.

We claim:

1. A mixer ejector flow distributor (20, 20') for promoting improved flow in an air flow conduit (11, 11'), said air flow conduit having an axis of symmetry (A, A') and an interior wall, comprising a mixer lobe array located within said air flow conduit and comprising wall means (21, 21') having an axis of symmetry coincident with said axis of symmetry of said air flow conduit, a first side and a second side, a plurality of adjoining lobes (31, 31'), with each said lobe extending lengthwise along said wall means in a direction from upstream to downstream in said air flow conduit and gradually increasing in height from upstream to downstream in said air flow conduit and a wave-like downstream end (32, 32') defined by said plurality of adjoining lobes;

a faired body (22, 22') located adjacent said wall means, said faired body having an axis of symmetry coincident with said axis of symmetry of said air flow conduit and a cross section, in a plane passing through said axes of symmetry, that is an airfoil, said airfoil having a leading edge (41, 41') oriented upstream in said air flow conduit from a trailing edge (42, 42');

an ejector passage (51, 51') formed between said first side of said wall means and said faired body from an ejector inlet (52, 52') to an ejector outlet (53, 53'); and a primary flow passage (71, 71') adjacent said second side of said wall means with alternate said lobes of said mixer array penetrating, respectively, into said ejector passage and said primary flow passage so that a lobe in one of said passages is a corresponding trough in the other of said passages.

2. The mixer ejector flow distributor of claim 1 in which said wall means (21) is between said faired body (22) and said axes of symmetry (A), said air flow conduit (11) has a downstream outlet (13), said wall means (21) surrounds said primary flow passage (71) and in which said mixer ejector flow distributor further comprises an outlet cuff (23) that surrounds said air flow conduit, said outlet cuff having a first end (61) that joins and forms a closure with said air flow conduit upstream, with respect to air flow direction in said primary flow passage (71), from said faired body (22), a second end (62) and an interior wall, so that said wall means and said faired body form, between said outlet cuff interior wall and said faired body, a recirculating air passage (63) from an annular recirculating air inlet (64), between said faired body trailing edge (42) and said outlet cuff second end to said ejector inlet (52).

3. The mixer ejector flow distributor of claim 1 in which said faired body (22') is between said wall means (21') and said axes of symmetry (A'), said wall means surrounds said faired body and said primary flow passage (71') is between said wall means and said air flow conduit interior wall.

* * * * *